US007457564B2

(12) United States Patent
Takami

(10) Patent No.: US 7,457,564 B2
(45) Date of Patent: Nov. 25, 2008

(54) CONTAINER HOLDING DEVICE, CONVEYING DEVICE, IMAGE FORMING APPARATUS, AND METHOD OF FIXING CONTAINER

(75) Inventor: Nobuo Takami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 418 days.

(21) Appl. No.: 10/560,778

(22) PCT Filed: Mar. 14, 2005

(86) PCT No.: PCT/JP2005/004887

§ 371 (c)(1),
(2), (4) Date: Dec. 14, 2005

(87) PCT Pub. No.: WO2005/098548

PCT Pub. Date: Oct. 20, 2005

(65) Prior Publication Data

US 2006/0182468 A1 Aug. 17, 2006

(30) Foreign Application Priority Data

Mar. 19, 2004 (JP) ..... 2004-081611
Mar. 27, 2004 (JP) ..... 2004-279113

(51) Int. Cl.
*G03G 15/08* (2006.01)

(52) U.S. Cl. ..... 399/120; 399/258

(58) Field of Classification Search ..... 399/120, 399/258

See application file for complete search history.

(56) References Cited

U.S. PATENT DOCUMENTS

| | | | | |
|---|---|---|---|---|
| 5,594,535 | A * | 1/1997 | Beaufort et al. | 399/262 |
| 7,065,313 | B2 * | 6/2006 | Matsumoto et al. | 399/262 |
| 2001/0033758 | A1 * | 10/2001 | Katsuyama | 399/258 |
| 2004/0037591 | A1 * | 2/2004 | Schlageter et al. | 399/258 |

FOREIGN PATENT DOCUMENTS

| | | |
|---|---|---|
| JP | 2001-194907 | 7/2001 |
| JP | 2001-324863 | 11/2001 |
| JP | 2002-72649 | 3/2002 |
| JP | 2003-295726 | 10/2003 |
| JP | 2004-4559 | 1/2004 |
| JP | 2004-12687 | 1/2004 |

* cited by examiner

*Primary Examiner*—David M Gray
*Assistant Examiner*—Bryan Ready
(74) *Attorney, Agent, or Firm*—Oblon, Spivak, McClelland, Maier & Neustadt, P.C.

(57) ABSTRACT

A container holding device includes a container guide member (60) that holds a toner container (50). The toner container (50) can be detachably attached to the container guide member (60). The toner container (50) includes a soft, shrinkable bag (51) for storing contents such as toner. The container guide member (60) can move between a first position at which the toner container (50) is detachably attached and a second position at which the contents of the toner container (50) can be discharged. A moving unit moves the container guide member (60) between the first and second positions. An external pressurizing unit shrinks the bag (51) by applying external pressure, and applies a lower pressure when the container guide member (60) is at the first position than at the second position.

16 Claims, 12 Drawing Sheets

CONTAINER HOLDING DEVICE, CONVEYING DEVICE, IMAGE FORMING APPARATUS, AND METHOD OF FIXING CONTAINER

TECHNICAL FIELD

The present invention relates to a technology for holding a container that stores powder, liquid, gas and the like, conveying the contents stored in the container holding device to another device.

BACKGROUND ART

Container holding devices for holding containers, which store powder, liquid, gas and the like, are used in various fields. For example, a container holding device is used in image forming apparatuses for holding a toner container. In case of the image forming apparatuses, a holding part holds the toner container, and a toner conveying device supplies the toner to a developing device of the image forming apparatus.

Toner containers made of hard materials, such as bottles or cartridges, are known. However, the hard toner containers do not shrink when the toner is finished.

Japanese Patent Application Laid-Open Publication Nos. 2001-194907, 2001-324863, and 2002-72649 disclose toner containers that are bag-shaped, made of soft material, and can be reduced in size and volume by a suction pump. These soft toner containers shrink when the toner is finished. The soft containers are better than the hard containers in various respects. For example, because the soft containers shrink, more containers can be accommodated in the same space, so that the transportation costs of returning used toner containers to the manufacturer can be reduced.

However, when the soft toner container shrinks, creases are formed on the container and the toner gets caught in the creases, and cannot be stably supplied to the toner outlet. One approach is to provide fold lines on the container, so that the container shrinks in a fixed shape along the fold lines, and is neatly folded without creases. However, creases are formed even if fold lines are provided. A countermeasure is to provide pressurizing guide members (external pressurizing means) that apply pressure along the fold lines.

However, the pressurizing guide members become obstacles when replacing an empty toner container with a new container. Therefore, the user is required to strongly push the new toner container into its position, against the force of the pressurizing guide members. However, creases are formed on the toner container when it is strongly pushed into its position. In addition, if such creases are created, the container does not fold into a fixed shape along the fold lines, when shrinking. Also, the toner container is apt to tear when being fixed, because of the pressurizing guide members. Therefore, a relatively rigid material has to be used on the container where the fold lines are provided, however, the rigid material is hard to shrink.

These problems are not limited to the container holding device used for the toner conveying device in the image forming apparatus. Such problems also apply to any other container holding device for holding a soft container that shrinks as the contents are ejected.

DISCLOSURE OF THE INVENTION

A container holding device according to an aspect of the present invention includes a container holding member that holds a container, wherein the container can be detachably attached to the container holding member, includes a soft, bag-shaped member that stores contents, and shrinks as external pressure is applied or internal pressure reduces, the container holding member capable of moving between a first position that is a position at which the container is attached to or detached from the container holding member and a second position that is a position at which the contents of the container can be discharged; a moving unit that moves the container holding member between the first position and the second position; and an external pressurizing unit that applies external pressure to the bag-shaped member at least while the container holding member is at the first position and the second position so that the bag-shaped member shrinks when the contents are being discharged, wherein the external pressurizing unit applies a lower pressure to the bag-shaped member when the container holding member is at the first position than when the container holding member is at the second position.

A conveying device according to another aspect of the present invention includes the above container holding device; a discharging unit that causes the contents to be discharged from an outlet of the container by causing the bag-shaped member to shrink by applying external pressure to the bag-shaped member or reducing internal pressure in the bag-shaped member; and a conveying member that conveys the contents discharged from the outlet to another device.

An image forming apparatus according to still another aspect of the present invention includes the above developing device; a discharging unit that causes the contents to be discharged from an outlet of the container by causing the bag-shaped member to shrink by applying external pressure to the bag-shaped member or reducing internal pressure in the bag-shaped member; and a conveying member that conveys the contents discharged from the outlet to another device.

According to still another aspect of the present invention, a method of fixing a container to a container holding device that includes a container holding member, wherein the container has a soft, bag-shaped member that stores contents, shrinks as external pressure is applied or internal pressure reduces, and can be detachably attached to the container holding member, includes moving the container holding member to a first position that is a position at which the container is attached to or detached from the container holding member, from a second position that is a position at which the contents of the container can be discharged; placing the container at the container holding member at the first position; allowing the container to drop by its own weight until an outlet of the container is set where the contents are discharged; moving the container holding member from the first position to the second position; and increasing pressure that is applied to the bag-shaped member as the container holding member moves from the first position to the second position.

The other objects, features, and advantages of the present invention are specifically set forth in or will become apparent from the following detailed description of the invention when read in conjunction with the accompanying drawings.

BEST MODE FOR CARRYING OUT THE INVENTION

Exemplary embodiments of the present invention are explained below with reference to the accompanying drawings. For the sake of explanation, the present invention is applied to an image forming apparatus; moreover, the image forming apparatus is assumed to be a tandem-type color laser printer (hereinafter, "printer").

Figure 1:
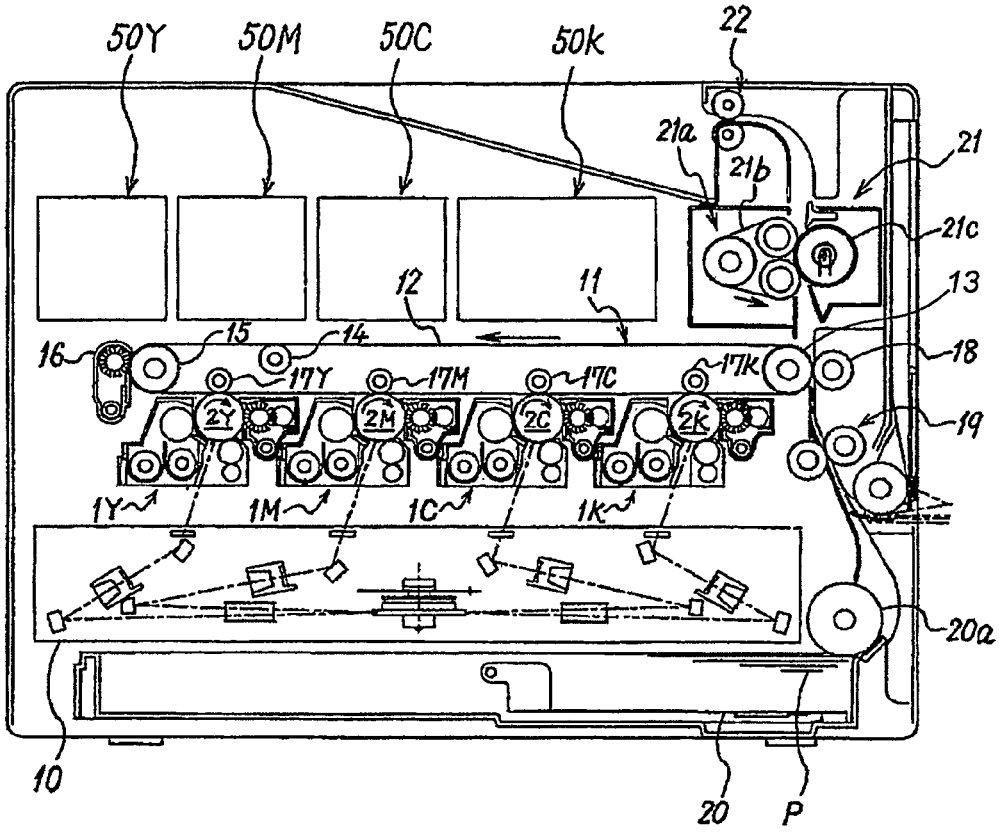
FIG. 1 is a schematic diagram of a printer according to an embodiment of the present invention.

FIG. 1 is a schematic diagram of a printer according to an embodiment of the present invention. The printer includes four sets of process units, 1Y, 1M, 1C, and 1 K, that form yellow (Y), magenta (M), cyan (C), and black (K) images, respectively. Hereinafter, a symbol Y, M, C or K denoted after a number represents that the corresponding member is for yellow, magenta, cyan or black. The printer includes an optical writing unit 10, an intermediate transfer unit 11, a secondary transfer bias roller 18, a pair of registration rollers 19, a paper feeding cassette 20, and a belt-type fixing unit 21. The optical writing unit 10 includes a light source, polygon mirrors, f-θ lenses, reflecting mirrors, and irradiates a laser beam on the surface of a photosensor based on image information.

Figure 2:
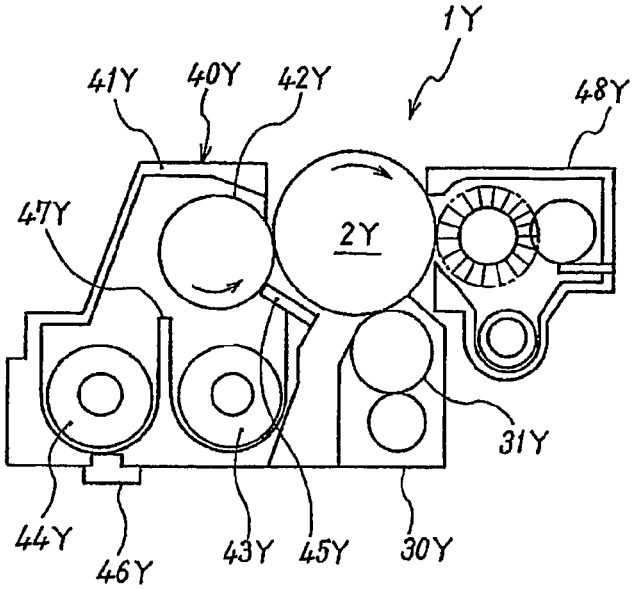
FIG. 2 is an enlarged view of a process unit for yellow in the printer.

FIG. 2 illustrates an enlarged view of the process unit 1Y. The other process units 1M, 1C, and 1K have similar configuration so the descriptions thereof are omitted to avoid redundant explanation. The process unit 1Y includes a drum-shaped photosensor 2Y, a charging device 30Y, a developing device 40Y, a drum cleaning device 48Y, and a discharging device (not shown).

The charging device 30Y includes a charging roller 31Y that is applied with alternating voltage. The charging roller 31Y rubs against the photosensor 2Y, so as to uniformally charge the surface of the photosensor 2Y in the dark. A laser beam that is modulated and deflected by the optical writing unit 10, scans and irradiates the surface of the charged photosensor 2Y. As a result, an electrostatic latent image is formed on the surface of the photosensor 2Y. The developing device 40Y develops the electrostatic latent image to form a Y toner image.

The developing device 40Y includes a developing roller 42Y that is housed in a case 41Y. The developing roller 42Y is arranged such that a part of the surface of the developing roller 42Y is exposed from an opening in the case 41Y. The developing device 40Y also includes a first conveying screw 43Y, a second conveying screw 44Y, a doctor blade 45Y, and a toner density sensor 46Y housed in the case 41Y.

The case 41Y stores two-component developer (not shown) including magnetic carriers and negatively charged Y toner. The first conveying screw 43Y and the second conveying screw 44Y stir and convey the two-component developer so as to friction charge the two-component developer. The charged two-component developer is then carried on the surface of the developing roller 42Y. The doctor blade 45Y controls the thickness of the developer before the developer is conveyed to a developing area facing the photosensor 2Y, where the Y toner adheres to an electrostatic latent image on the photosensor 2Y. As a result, the Y toner image is formed on the photosensor 2Y. After the Y toner is used up for development, the two-component developer is returned into the case 41Y by the rotation of the developing roller 42Y. A partition 47Y is provided between the first conveying screw 43Y and the second conveying screw 44Y. The partition 47Y divides the case 41Y into a first compartment including the developing roller 42Y and the first conveying screw 43Y, and a second compartment including the second conveying screw 44Y. The first conveying screw 43Y is rotated by a driving unit (not shown) to convey the two-component developer in the first compartment to the developing roller 42Y. The two-component developer conveyed to the corner of the first compartment by the first conveying screw 43Y enters into the second compartment through an opening (not shown) in the partition 47Y. The second conveying screw 44Y is rotated by a driving unit (not shown) to convey the two-component developer, coming from the first compartment, in a direction opposite to that of the first conveying screw 43Y. The two-component developer conveyed to the corner of the second compartment by the second conveying screw 44Y returns to the first compartment through another opening (not shown) in the partition 47Y.

The toner density sensor 46Y, which can be a permeability sensor, is situated near the center of the bottom wall of the second compartment, and outputs a voltage according to the permeability of the two-component developer passing over the toner density sensor 46Y. The permeability and the toner density of the two-component developer are substantially correlated, so the voltage output from the toner density sensor 46Y is in accordance with the density of the Y toner. A signal of the voltage is transmitted to a control unit (not shown). The control unit includes a RAM that stores a Vtref for Y, that is a reference voltage. The reference voltage is the optimal voltage to be output from the toner density sensor 46Y. The RAM also stores the Vtref data for M, C, and K. The Vtref for Y is used to control the operation of a Y toner conveying device (not shown). Specifically, the control unit controls the Y toner conveying device to supply an appropriate amount of Y toner into the second compartment, so that the voltage output from the toner density sensor 46Y approaches the Vtref for Y. As a result, the Y toner density of the two-component developer in the developing device 40Y is maintained within a predetermined range. The toner supply is controlled in the same manner in the developing devices of the other process units.

The Y toner image formed on the photosensor 2Y is transferred onto an intermediate transfer belt (not shown). After the transfer, the drum cleaning device 48Y cleans off the residual toner on the surface of the photosensor 2Y, and a discharging lamp discharges and the photosensor 2Y. Then, the charging device 30Y uniformly charges the photosensor 2Y to form a next image. The other process units perform the same process.

As illustrated in FIG. 1, the intermediate transfer unit 11 includes an intermediate transfer belt 12, a driving roller 13, stretching rollers 14 and 15, a belt cleaning device 16, and four intermediate transfer bias rollers 17Y, 17M, 17C, and 17K. The intermediate transfer belt 12 is tensely stretched by the driving roller 13, the stretching rollers 14 and 15, and is endlessly revolved in an anti-clockwise direction as viewed in the figure by the driving roller 13 that is rotated by a driving system (not shown). Intermediate transfer bias is applied to the intermediate transfer bias rollers 17Y, 17M, 17C, and 17K from a power source (not shown). Then, the intermediate transfer bias rollers 17Y, 17M, 17C, and 17K push the intermediate transfer belt 12 towards the photosensors 2Y, 2M, 2C, and 2K. As a result, a nip is formed between each of the intermediate transfer bias rollers and the corresponding photosensors. In each of the nips, an electric field is formed due to the intermediate transfer bias. The Y toner image formed on the photosensor 2Y is transferred onto the intermediate transfer belt 12 due to the electric field and the pressure of the nip. The M, C, and K toner images formed on the photosensors 2M, 2C, and 2K are sequentially superimposed on the Y toner image. As a result, a four-color toner image is formed on the intermediate transfer belt 12. The four-color toner image is then transferred onto a transfer paper P, which is a recording material. The belt cleaning device 16 is located near the stretching roller 15 in close contact with the intermediate transfer belt 12. The belt cleaning device 16 cleans off the toner remaining on the surface of the intermediate transfer belt 12 after the transfer.

The paper feeding cassette 20, which stores the transfer paper P in a stack, is located below the optical writing unit 10. A paper feeding roller 20*a* is pushed against the top transfer paper P. When the paper feeding roller 20*a* rotates at a predetermined timing, the top transfer paper P is led into a paper conveying path.

In the intermediate transfer unit 11, the driving roller 13 contacts the secondary transfer bias roller 18, with the intermediate transfer belt 12 interposed between the two rollers, forming a nip. Secondary transfer bias is applied to the secondary transfer bias roller 18 from a power source (not shown).

The transfer paper P fed into the paper conveying path is sandwiched between the pair of registration rollers 19. As the intermediate transfer belt 12 rotates, the four-color toner image formed on the intermediate transfer belt 12 enters the nip. The pair of registration rollers 19 sends out the transfer paper P at a timing such that the transfer paper P comes into contact with the four-color toner image at the nip. The four-color toner image is then transferred to the transfer paper P at the nip due to the secondary transfer bias and the pressure of the nip, forming a full-color image on the transfer paper P. The transfer paper P with the full-color image is conveyed to the fixing unit 21.

The fixing unit 21 includes a belt unit 21*b*, in which a fixing belt 21*a* is stretched by three rollers and is endlessly revolved, and a heating roller 21*c* having a heat source inside. The transfer paper P is conveyed in between the belt unit 21*b* and the heating roller 21*c*, so that the full-color image is fixed on the surface of the transfer paper P. A pair of paper discharge rollers 22 leads the transfer paper P outside the printer.

As described above, the printer includes a visible image forming unit that forms a visible image onto a recording material, by using the process units 1Y, 1M, 1C, 1K, the intermediate transfer unit 11, and so forth.

Next, toner containers 50Y, 50M, 50C, 50K containing toner of Y, M, C, K, respectively, are described.

Figure 3:
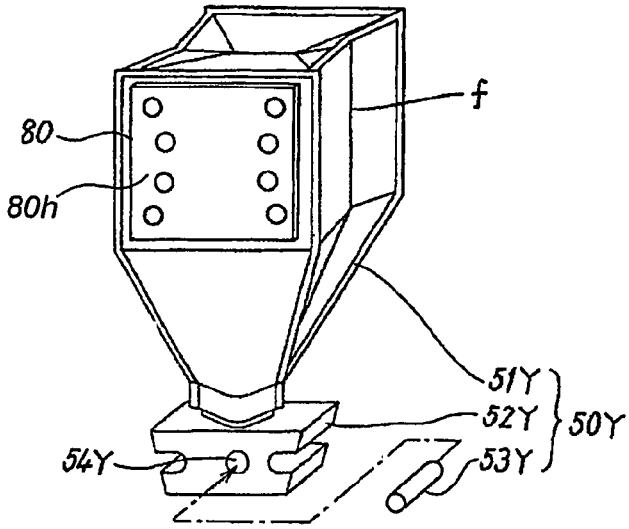
FIG. 3 is a perspective view of a toner container for Y toner.

FIG. 3 is a perspective view of the toner container 50Y. The toner container 50Y includes a bag part 51Y that is bag-shaped, made of soft material, a mouth part 52Y that is a cap member, and a rod 53Y. The bag part 51Y is square-shaped, made of a single sheet or layers of sheets, and has a thickness of from 50 micrometers (μm) to 210 μm, and it is shrinkable. The bag part 51Y contains Y toner. The sheet can be made of a resin material including polyester, polyethylene, and nylon, or it can be made of paper. In the present embodiment, the bag part 51Y has two layers: a polyethylene sheet on the inside, that welds to the mouth part 52Y; and a nylon sheet on the outside. The bag part 51Y also has reinforcing layers 80, made of a material including polyethylene terephthalate and aluminum, provided on two opposing sides.

Fold lines f are provided on the bag part 51Y on the sides where the reinforcing layers 80 are not provided. When the bag part 51Y shrinks, the surfaces provided with the reinforcing layers 80 are maintained in a flat state due to the strength of the reinforcing layers 80, without forming any creases. Therefore, the fold lines f do not deform and remain straight. As a result, the bag part 51Y gets neatly folded along the fold lines f when shrinking.

There are eight holes 80*h* on each of the reinforcing layers 80. A user can hook his fingers into these holes 80*h*, so that it becomes easy when holding the toner container 50Y to shake it, or when fixing it into a container holder. These holes 80*h* also function as reference marks that indicate appropriate positions where to place the user's fingers. This prevents the user from holding the bag part 51Y in such a way that the fold lines f deform, so that the bag part 51Y shrinks in a fixed shape.

The upper half of the bag part 51Y is a substantially rectangular solid shape when inflated, and the bottom half is an inverse quadrangular pyramid (in a taper form), forming a hopper that pours the toner downwards to the mouth part 52Y. The mouth part 52Y is made of a rigid material including resin, and is weld to the tip of the hopper. The toner container 50Y is positioned such that the mouth part 52Y is at the bottom, and the bag part 51Y is connected to the mouth part 52Y. A through hole 54Y is formed in the mouth part 52Y. When the rod 53Y is inserted into this through hole 54Y, the Y toner (not shown) in the toner container 50Y does not ooze out. The other toner containers 50M, 50C, and 50K have a configuration that is similar to that of the toner container 50Y, so the descriptions thereof are omitted.

Next, a configuration and operation of the toner conveying device that conveys the toner to the developing device is described below.

Figure 4:
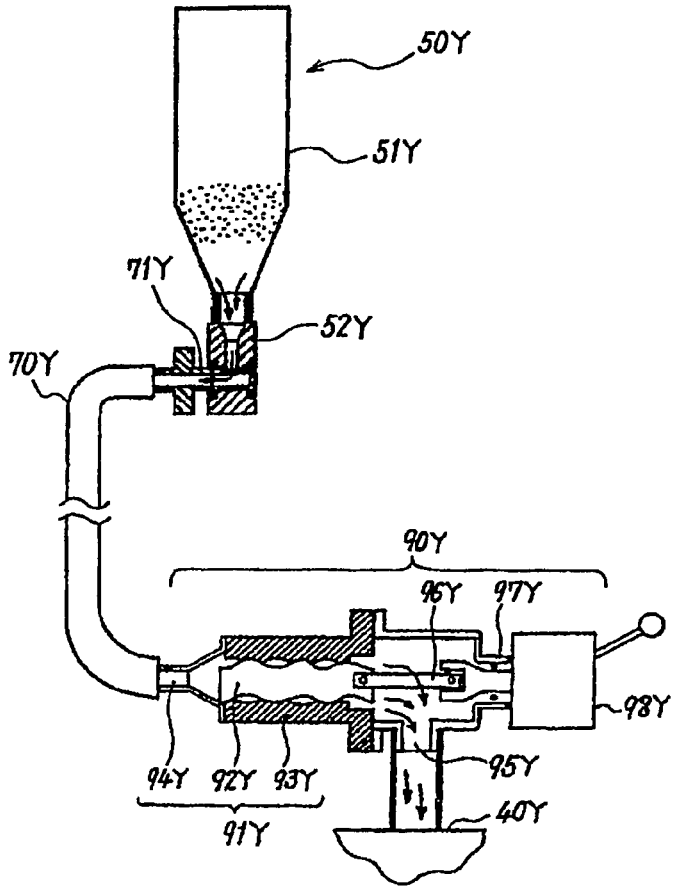
FIG. 4 is a diagram of the toner conveying device for Y toner and a part of a developing device for Y toner.

FIG. 4 is a diagram of the toner conveying device Y and a part of the developing device for the Y toner. The toner conveying device includes a conveying tube 70Y, a nozzle 71Y that forms a toner conveying path, and a suction pump 90Y. The container holder (not shown) holds the toner container 50Y. The toner container 50Y is fixed into the container holder such that the mouth part 52Y is positioned at the bottom. The toner container 50Y is replaced with a new toner container when the toner is substantially finished. The nozzle 71Y is inserted into the through hole 54Y of the mouth part 52Y of the new toner container 50Y, pushing out the rod 53Y from the through hole 54Y. As a result, the nozzle 71Y is connected to the mouth part 52Y and the toner conveying path is formed. The Y toner ejected from the toner container 50Y is conveyed to the developing device 40Y through the toner conveying path.

The other end of the nozzle 71Y is connected to the conveying tube 70Y. The conveying tube 70Y is made of a flexible material such as rubber or resin that has excellent toner resistance, and has an internal diameter of 4 millimeters (mm) to 10 mm. The other end of the conveying tube 70Y is connected to a pump part 91Y included in the suction pump 90Y. The suction pump 90Y is a so-called uniaxial eccentric screw pump, which includes the pump part 91Y, a discharge part 95Y in connection with the pump part 91Y, an axial member 96Y, a universal joint 97Y, and a suction motor 98Y.

The pump part 91Y includes a rotor 92Y in a shape of an eccentric double-thread screw, made of metal or highly rigid resin, a stator 93Y that is hollow inside in the shape of a double-thread screw and made of rubber, and an inhalator 94Y. When the suction motor 98Y rotates, the rotational drive is transmitted to the rotor 92Y via the universal joint 97Y and the axial member 96Y. As a result, the rotor 92Y rotates inside the stator 93Y, and then negative pressure is generated at the inhalator 94Y. Due to the negative pressure, the Y toner in the bag part 51Y is sucked into the suction pump 90Y through the mouth part 52Y, the nozzle 71Y, and the conveying tube 70Y, and is then discharged into the discharge part 95Y through the stator 93Y. The discharge part 95Y is connected to the second compartment of the developing device 40Y, and the Y toner is supplied to the second compartment to be mixed with the two-component developer (not shown).

The toner container 50Y does not require any movable members such as an auger to convey the Y toner, because the suction pump 90Y conveys the Y toner. Accordingly, the toner container 50Y can be simple in structure and light-weight. In addition, the suction pump 90Y shrinks the bag part 51Y, reducing the volume of the toner container 50Y. As a result, transportation costs can be reduced when returning the used toner containers 50Y to the manufacturer for recycling purposes. Also, the conveying tube does not require any screws, etc., to convey the toner, so the conveying tube 70Y can bend flexibly. Moreover, the toner container 50Y does not necessarily need to be located below the developing device 40Y, because the suction pump 90Y can pump up and convey the toner, regardless of gravity. As a result, the toner conveying path can be laid out anywhere in the printer, which is advantageous in various respects.

Figure 5:
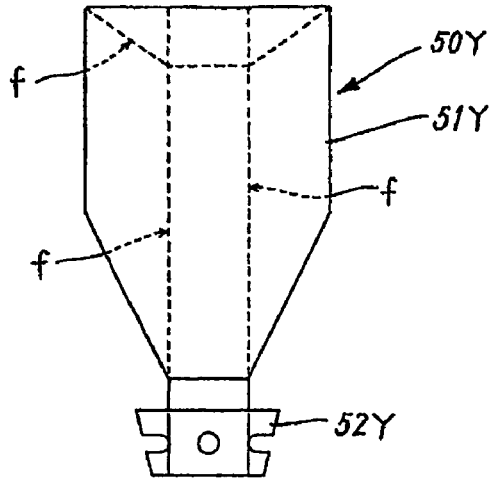
FIG. 5 is the toner container in a substantially flat shape.

Because the fold lines f are provided on the bag part 51Y, the bag part 51Y shrinks along the fold lines f due to the suction, and folds into a substantially flat shape as illustrated in FIG. 5. Hence, the transportation costs of the used containers can be further reduced.

Figure 6:
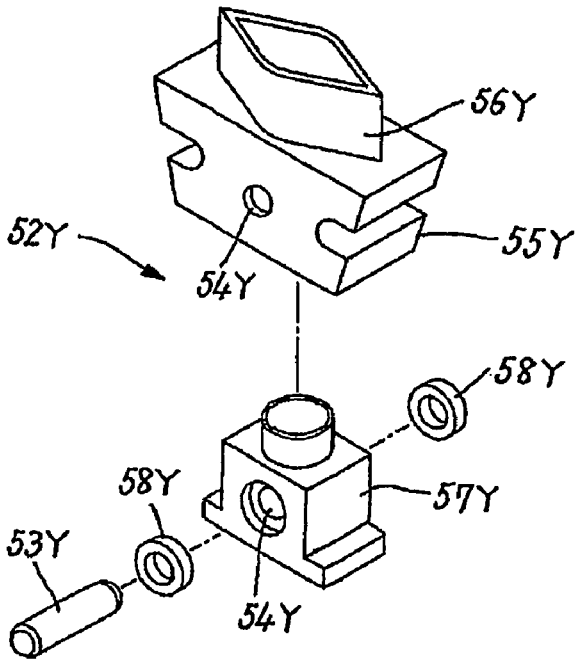
FIG. 6 is a perspective view of an example of a configuration of a mouth part of the toner container in a disassembled state.

FIG. 6 is a perspective view of an example of a configuration of a mouth part of the toner container 50Y, in a disassembled state. The mouth part 52Y includes a main part 55Y with a large vertical hole and a horizontal through hole 54Y, and a welding part 56Y that protrudes above the main part. There is also a cap part 57Y that fits into the vertical hole of the main part 55Y from below. The welding part 56Y is welded to the opening of the bag part 51Y and fixes the mouth part 52Y to the bottom of the bag part. The cap part 57Y also has the through hole 54Y. Accordingly, when the cap part 57Y is fitted into the main part 55Y, the through hole 54Y penetrates both the main part 55Y and the cap part 57Y in a horizontal direction. Ring-shaped seals 58Y made of an elastic material such as rubber, are provided around the through hole 54Y of the cap part 57Y. Thus, when the rod 53Y or the nozzle 71Y is inserted into the through hole 54Y, the inside of the cap part 57Y is sealed off from outside.

The mouth part 52Y is divided into the main part 55Y and the cap part 57Y so that the Y toner can be easily supplied into the bag part 51Y. If the main part 55Y and the cap part 57Y were combined as one unit, the Y toner has to be supplied from the small through hole 54Y, which is positioned at 90 degrees with respect to the toner path from the bag part 51Y. On the other hand, if the main part 55Y and the cap part 57Y are separable, the Y toner can be supplied straightly into the bag part 51Y from the large opening of the mouth part 52Y. This can prevent the toner from soiling the seals 58Y. Meanwhile, the diameter of the rod 53Y is to be small enough so that the user's finger does not accidentally push the rod 53Y out of the through hole 54Y. The cross-sectional area of the rod 53Y is to be 8 $mm^2$ or less, preferably 6 $mm^2$ or less.

Figure 7:
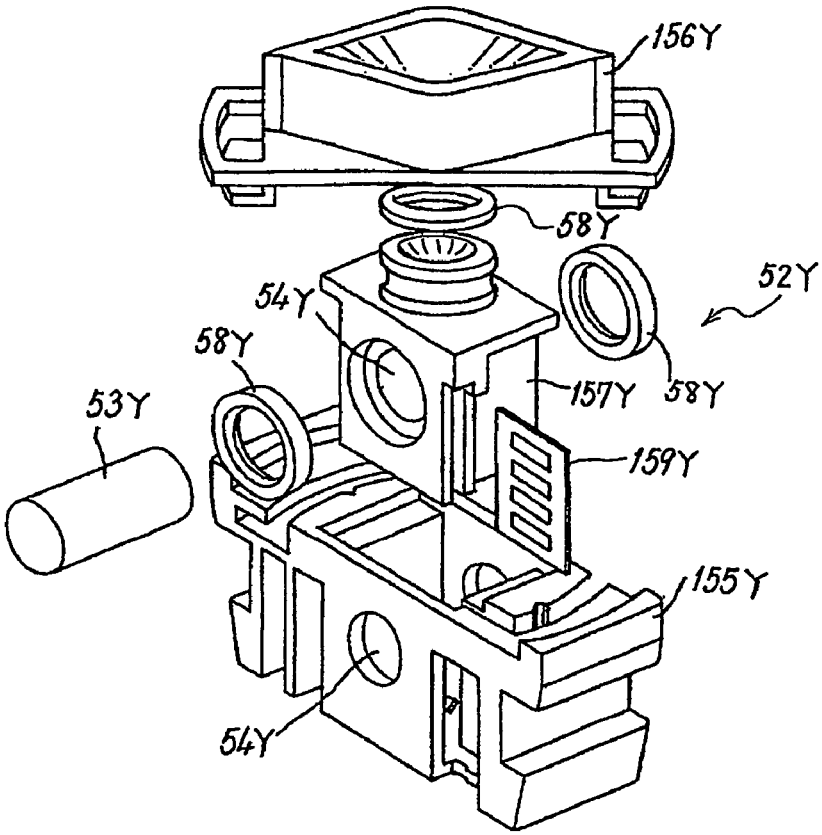
FIG. 7 is a perspective view of another example of a configuration of the mouth part of the toner container in a disassembled state.

FIG. 7 is a perspective view of another example of a configuration of the mouth part of the toner container 50Y, in a disassembled state. The mouth part 52Y includes a welding part 156Y and a main part 155Y that fits into the welding part 156Y. There is also included a cap part 157Y that fits into a vertical hole of the main part 155Y from above. The welding part 156Y is welded to the opening of the bag part 51Y. The cap part 157 fits into the vertical hole of the main part 155, and the main part connects to the welding part 156Y, so that the mouth part 52Y is fixed to the bottom of the bag part. A ring-shaped seal 58Y is provided between the cap part 157Y and the welding part 156Y. In a normal environment, the seal is not required. However, in an environment of reduced pressure (in a high-altitude environment), the air leaks out of the bag part 51Y, and packing occurs in the toner when returned to a normal environment. In order to prevent this, the seals 58Y are provided.

Also, in the mouth part 52Y, a circuit board 159Y is provided in the main part 155Y. The circuit board 159Y includes an electric circuit and a memory to confirm whether the toner container 50Y is attached, and the remaining amount of toner. When the toner container 50Y is attached to the main part 155Y, a contact terminal of the circuit board 159Y and a contact terminal of the main part 155Y contact each other. The toner container 50Y and the main part 155Y exchange information by the contact terminals.

Figure 8:
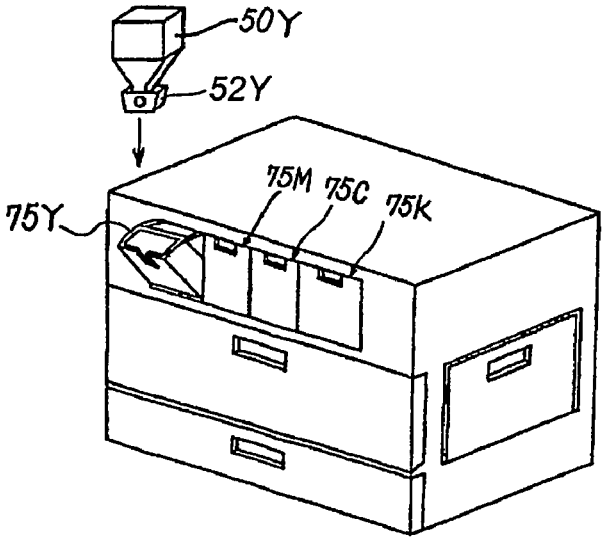
FIG. 8 is a perspective view of the printer.

FIG. 8 is a perspective view of the printer.

There are four container holders 75Y, 75M, 75C, and 75K, functioning as container holding devices, located on the front side of the printer. The container holders open and close, by pivoting on a rotational shaft (not shown). Each container holder constitutes part of the toner conveying device, and holds the toner container of the corresponding color. The user unlocks a lock (not shown) when setting the toner container 50Y into the container holder 75Y, so that the container holder 75Y opens towards the front. The user holds the bag part 51Y with both hands such that the mouth part 52Y is at the bottom in a vertical direction, and inserts the toner container 50Y into the container holder 75Y.

Figure 9:
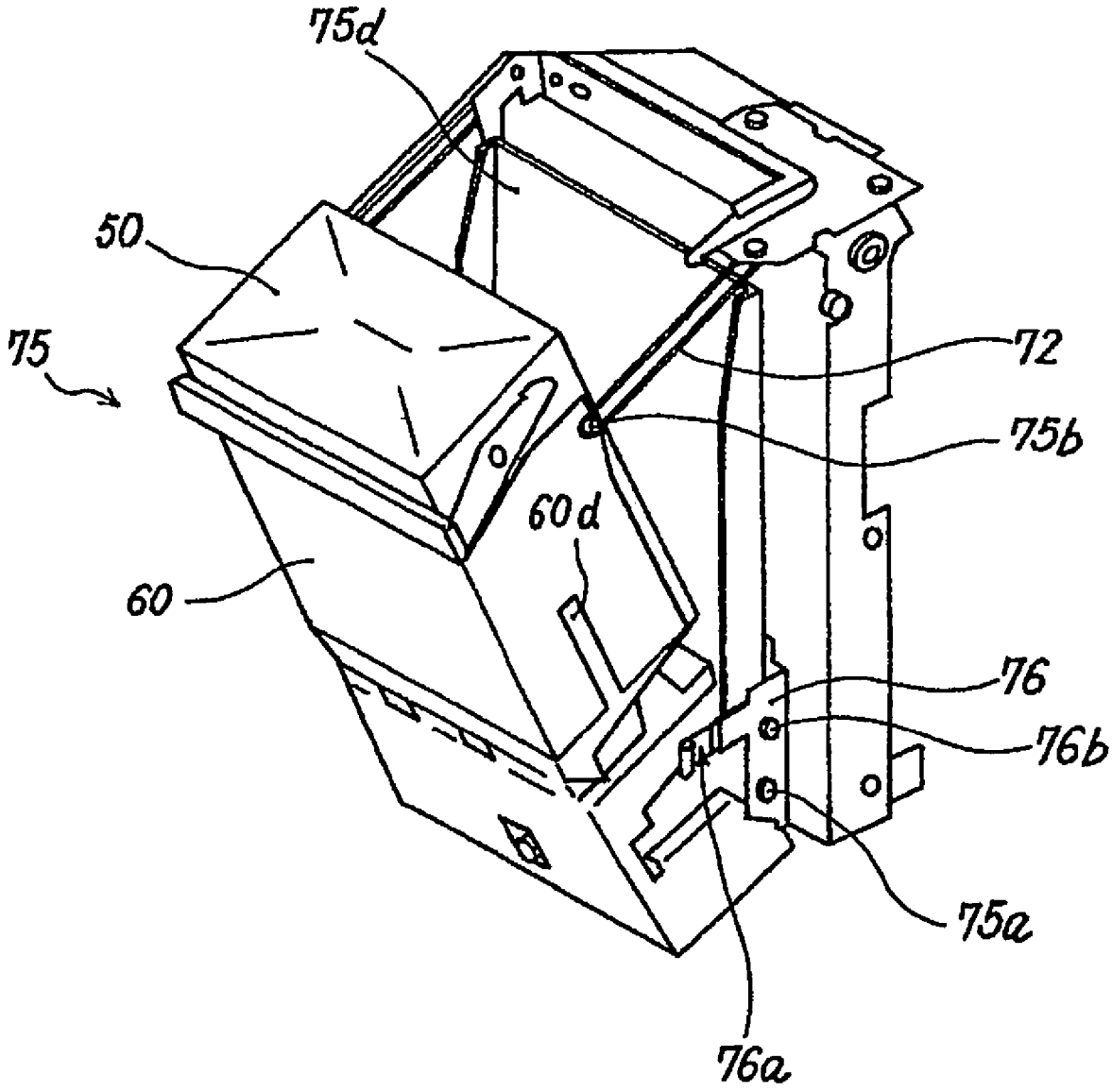
FIG. 9 is a perspective view of a container holder in the toner conveying device.

FIG. 9 is a perspective view of the container holder 75 of the toner conveying device for Y. The toner conveying devices for the other colors have similar configurations. The symbol for representing the color is omitted in the following description, for the sake of simplicity.

The toner conveying device includes a fixing member 76 that fixes the container holder 75 to the printer. A container guide member 60, functioning as a container holding member, is arranged at the bottom of the container holder 75. A rotational shaft 75*a*, located at the bottom of the container guide member 60, is fixed in the fixing member 76. The container holder 75 pivots on the rotational shaft 75*a*. A protrusion 75*b* is provided on the upper part of two opposing sides of the container guide member 60. The protrusion 75*b* is slidably connected to a slide member 72, which is rotatably attached to the printer. Therefore, the angle at which the container holder 75 opens is restricted by the slide members 72. The container holder 75 is capable of moving between an open position at which a toner container 50 is attached to or detached from the container guide member 60, and a closed position at which the toner container 50 is fixed into the container holder 75.

The container holder 75 is also provided with a back support part 75*d* that supports the toner container 50 on the back side facing the printer. The bottom edge of the back support part 75*d* is rotatably fixed to the container holder 75. When the container holder 75 is open, the back support part 75*d* leans towards the front by its own weight, coming in contact with the container guide member 60. However, the back support part 75*d* can also move towards the printer. Therefore, even if the bottom part of a bag part 51 is inflated due to the toner, the toner container 50 can smoothly enter the container holder 75. When the container holder 75 is closed, the back support part 75*d* is sandwiched between the toner container 50 and the printer.

Figure 10:
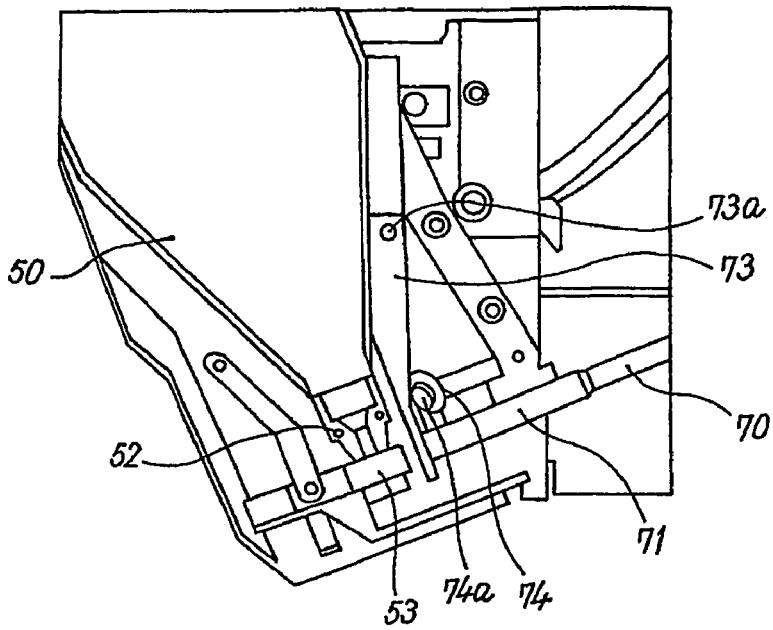
FIG. 10 is a cross-sectional view of the toner conveying device when the container holder is open.
Figure 11:
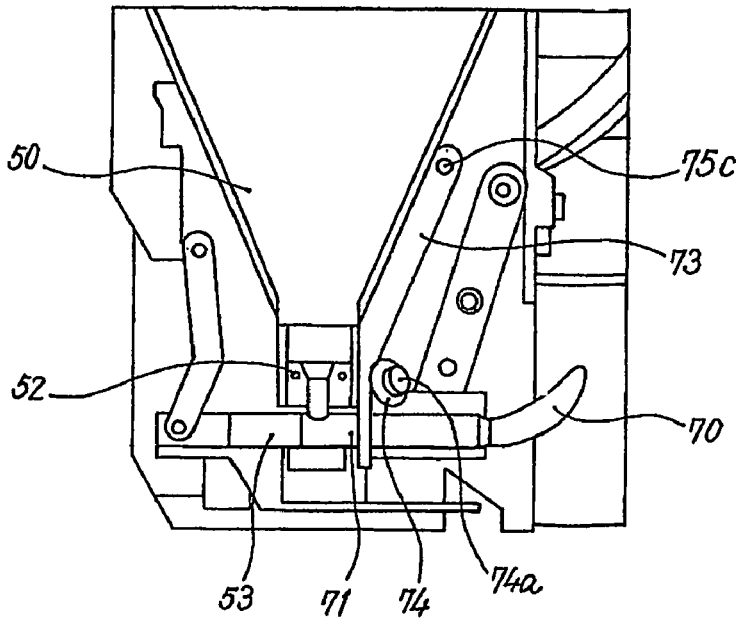
FIG. 11 is a cross-sectional view of the toner conveying device when the container holder is closed.

FIGS. 10 and 11 are cross-sectional views of the toner conveying device for Y, as if cut perpendicularly along the though hole of a mouth part 52, when the container holder 75 is open and closed, respectively.

The toner conveying device includes a movable plate 73 functioning as a cap holding member. The movable plate 73 is rotatably attached to the container holder 75 by a rotational shaft 73*a*, which is fixed to the bottom of the container holder 75. The movable plate 73 moves between a withdrawn position of FIG. 10 and a holding position of FIG. 11. A cam 74 is situated at the bottom part of the movable plate 73, on the side not facing the toner container 50. The cam 74 includes a cam shaft 74*a* that is rotatably attached to the container holder 75. The cam 74 is rotated by a cam driving gear 74*b* (not shown) provided on the cam shaft 74*a*. The rotation of the cam 74 causes the movable plate 73 to move between the withdraws and holding positions on the rotational shaft 73*a*. The cam 74, the cam shaft 74*a*, and the cam driving gear 74*b* function as a positioning means.

Figure 12:
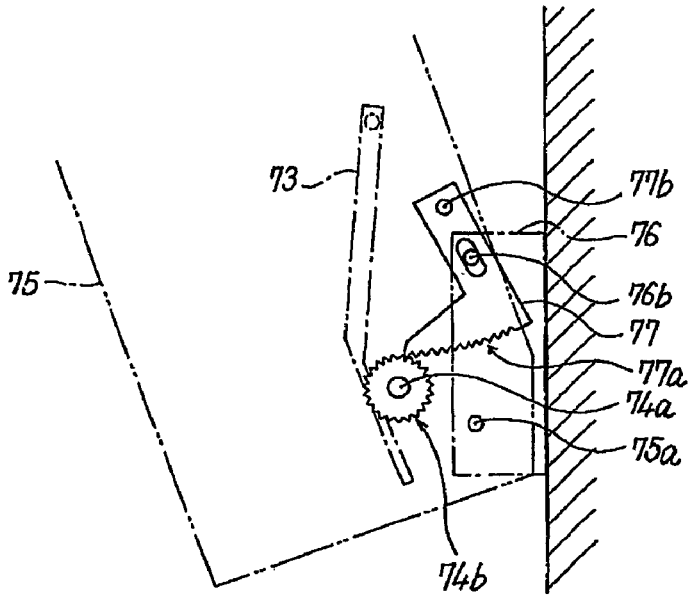
FIG. 12 is a cross-sectional view of a driving mechanism that rotates a cam when the container holder is open.
Figure 13:
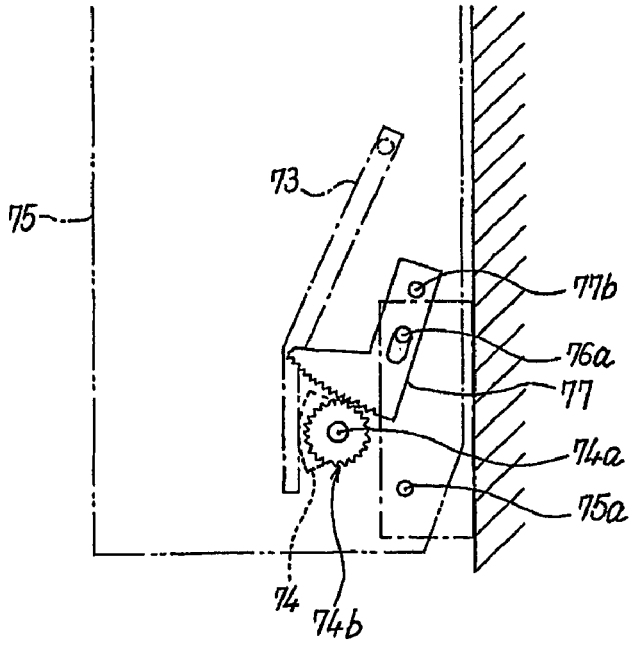
FIG. 13 is a cross-sectional view of the driving mechanism when the container holder is closed.

FIGS. 12 and 13 illustrate a driving mechanism that rotates the cam 74, when the container holder 75 is open and closed, respectively. The container holder 75 and the movable plate 73 are indicated by chain double-dashed lines, and the fixing member 76 by chain-dashed lines.

The cam driving gear 74*b* is in meshing engagement with a gear part 77*a* of a substantially L-shaped sector gear 77. The end of the sector gear 77 is rotatably attached to a rotational shaft 77*b* that is fixed to the container holder 75. There is an oblong hole in the middle of the sector gear 77, through which a fixing shaft 76*b*, fixed to the fixing member 76, is inserted.

As the user closes the container holder 75, the rotational shaft 77*b* moves, and the sector gear 77 rotates in a clockwise direction around the fixing shaft 76*b*. The resulting rotational force is transmitted to the cam driving gear 74*b* via the gear part 77*a*. The cam driving gear 74*b* then rotates half a turn in an anti-clock wise direction. A sufficient rotational angle is required to rotate the cam driving gear 74*b* by half a turn, even if the container holder 75 opens by a small angle. With the above-described link mechanism, the sector gear 77 rotates by a large angle, and the gear ratio of the gear part 77*a* and the cam driving gear 74*b* is adjusted. The container holder 75 opens only by 23 degrees at maximum, however, the rotational angle of the cam 74 is 168 degrees. When the container holder 75 is closed, the cam 74 rotates, moving the movable plate 73 towards the toner container 50 into the holding position. In the holding position, the movable plate 73 holds the mouth part 52 in connection with the nozzle 71.

Conversely, when the container holder 75 is opened, the above mechanism is performed in reverse. The surface of the cam is separated from the movable plate 73, and the movable plate 73 is released from the holding position. As a result, the movable plate 73 can freely rotate on the rotational shaft 73*a*, and returns to the withdrawn position. A spring or the like can be employed to force the movable plate 73 to the withdrawn position.

The toner container 50 can smoothly enter the container holder 75 when the movable plate 73 is in the withdrawn position. If the movable plate 73 is in the holding position, the movable plate 73 or the inner walls of the container holder 75 are apt to block the mouth part 52. Hence, the mouth part 52 cannot be inserted into the full depth of the container holder 75 to connect with the nozzle 71. For this reason, the movable plate 73 is configured to move to the withdrawn position as the mouth part 52 enters the container holder 75 and contacts the movable plate 73. As a result, a larger space is provided to allow the mouth part 52 to smoothly reach the deepest part of the container holder 75, even if the mouth part 52 is not inserted straightly.

When the user closes the container holder 75 after the toner container 50 is properly set, the movable plate 73 moves to the holding position, so that the mouth part is connected to the nozzle 71.

When the mouth part 52 is inserted, the bag part 51 is more apt to fold upwards on the surface without the fold line f, compared to that with the fold line f. For this reason, the movable plate 73 is arranged so as to face the surface of the bag part 51 without the fold line f, to facilitate the smooth insertion of the mouth part 52.

Figure 14:
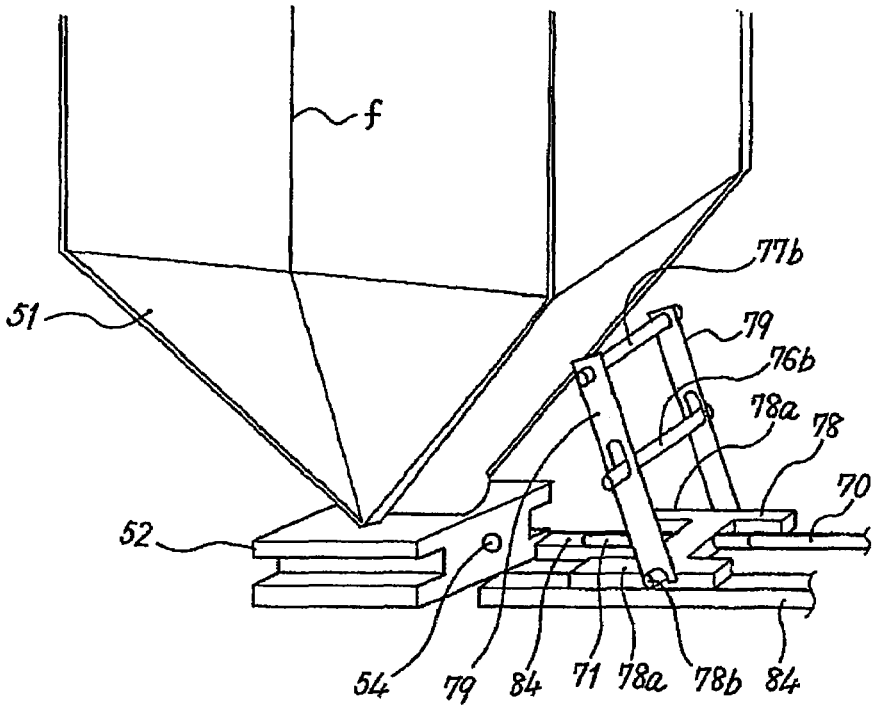
FIG. 14 is a perspective view of a nozzle driving mechanism when the container holder is open.
Figure 15:
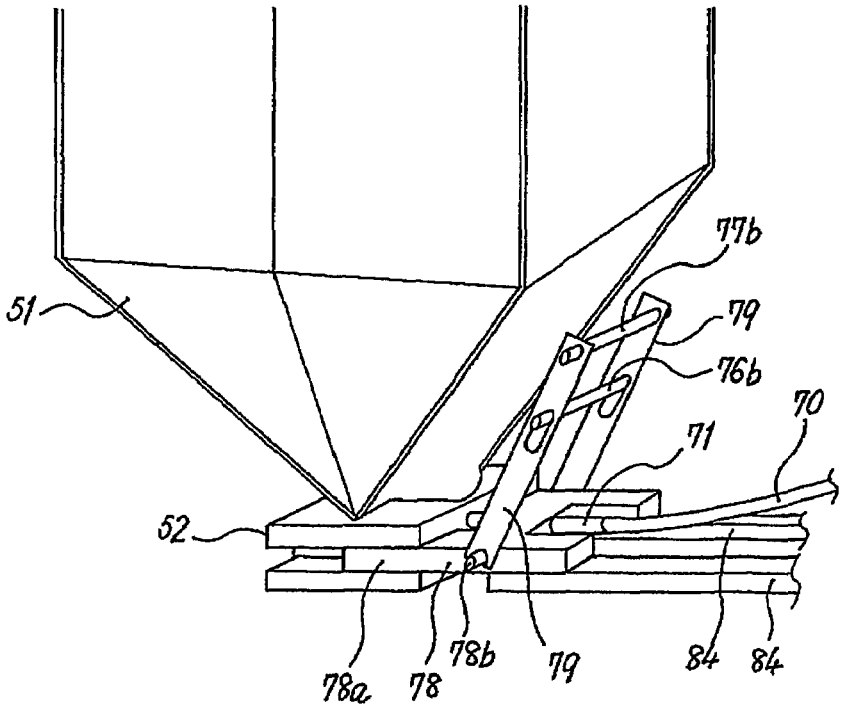
FIG. 15 is a perspective view of the nozzle driving mechanism when the container holder is closed.

FIGS. 14 and 15 illustrate a nozzle driving mechanism, when the container holder 75 is open and closed, respectively.

In the toner conveying device, one end of the nozzle 71 is attached to the bottom of the container holder 75, and the other end is connected to the conveying tube 70. The nozzle 71 is fixed to a nozzle holding member 78. The nozzle holding member 78 has two protruding parts 78*a* that protrude in a longitudinal direction parallel to the nozzle 71. As the nozzle 71 is inserted in the mouth part 52, the protruding parts 78*a* fit into notches of the mouth part 52. There are two protrusions 78*b* that rotatably attach two nozzle driving members 79 on two opposing sides of the nozzle holding member 78. The nozzle driving members 79 are located on the inside of the sector gear 77, and move together with the sector gear 77. The nozzle driving members 79 are connected by the rotational shaft 77*b* that is rotatably attached to the sector gear 77. When the user closes the container holder 75, the rotational shaft 77*b* is pushed away from the bag part 51. As a result, the nozzle driving members 79 rotate in a clockwise direction around the fixing shaft 76*b*. The resulting rotational force causes the nozzle holding member 78 to slide towards the mouth part 52 on a guide rail 84. The protruding parts 78*a* fit into the notches of the mouth part 52, and the nozzle 71 enters a through hole 54 of the mouth part 52. On the other hand, when the user opens the container holder 75, the above mechanism is performed in reverse. The nozzle holding member 78 slides away from the mouth part 52, pulling the nozzle 71 out of the through hole 54, allowing the toner container 50 to be removed.

Figure 16:
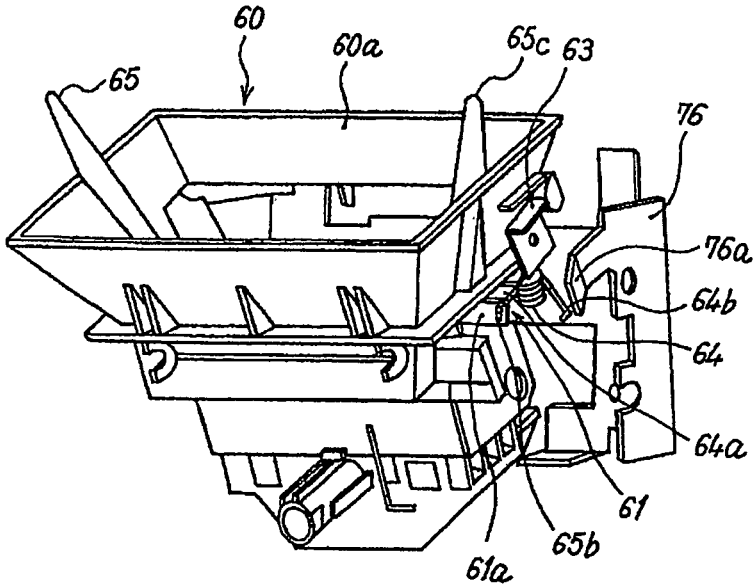
FIG. 16 is a perspective view of relevant parts of an external pressurizing unit when the container holder is open.
Figure 17:
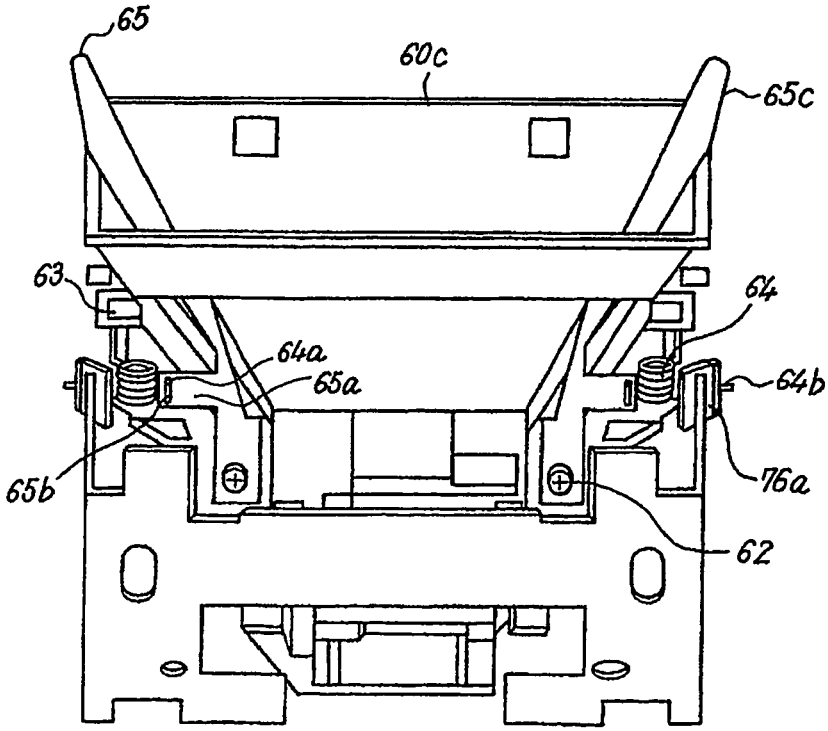
FIG. 17 is a front view of relevant parts of the external pressurizing unit when the container holder is open.

FIGS. 16 and 17 are a perspective view and a front view of relevant parts of an external pressurizing unit 61, respectively, when the container holder 75 is open. Inner surfaces 60*a* of the container guide member 60 form a taper that fits around the toner container 50 near the mouth part 52Y. Therefore, the toner container 50 can be easily accommodated. There are two external pressurizing units 61 provided on two opposing sides of the container guide member 60. The external pressurizing unit 61 includes a contact member 65, a torsion spring 64 that presses the contact member 65 against the fold line f of the toner container 50 (not shown), an arm part 76*a*, and a stud 63.

The external pressurizing unit 61 is positioned near the middle of the side of the container guide member 60. The contact member 65 contacts the fold line f of the bag part 51, at least where the upper half and the bottom half of the bag part 51 meet. The bottom end of the contact member 65 is rotatably attached to an inner part 60*c* of the container guide member 60 by a turn down screw 62. The contact member 65 is plate-shaped, made of a resin material. A protruding part 65*a* is located near the middle of the contact member 65, protruding outside of the container guide member 60. There is an oblong hole 65*b* in the protruding part 65*a*, through which one end 64*a* of the torsion spring 64 is inserted. The torsion spring 64 is rotatably attached to the stud 63. When the container holder 75 is closed, the other end 64*b* of the torsion spring 64 contacts the arm part 76*a* that extends from the fixing member 76. As a result, a supporting mechanism that supports the contact member 65 is formed. The edge of the arm part 76*a* bends outside, forming a tapering surface, so that the end 64*b* of the torsion spring 64 is easily guided to the arm part 76*a*.

When the container holder 75 is opened (as shown in FIG. 8), the end 64*b* of the torsion spring 64 is detached from the arm part 76*a*, and the supporting mechanism releases the contact member 65. As a result, the contact member 65 moves to a withdrawn position where it does not block the toner container 50, leaning towards the inner surface of the container guide member 60 by its own weight. This allows the toner container 50 to smoothly be attached to or detached from the container holder 75. The contact member 65 is configured to lean towards the withdrawn position by its own weight, by making the end 64*a* of the torsion spring 64 contact the lower part of the oblong hole 65*b*. Also, as illustrated in FIG. 9, a cutout part 60*d* is provided on both sides of the container guide member 60, so that a top part 65*c* of the contact member 65 protrudes outside when the contact member 65 is at the withdrawn position.

When a user opens the container holder 75, the contact members 65 move to the withdrawn positions, where they do not obstruct the process of replacing a used toner container 50 with a new one. Hence, the user is not required to strongly push in the toner container 50, as the toner container 50 smoothly enters the container holder 75 by its own weight. Moreover, the user can insert the toner container 50 without fear of being torn or damaged by the contact members 65. Therefore, the toner container 50 can be made of a soft material, which folds and shrinks easily.

When the user closes the container holder 75 after setting the toner container 50, the end 64*b* of the torsion spring 64 attached to the stud 63 comes into contact with the edge of the arm part 76*a*. With the movement of the container holder 75, the end 64*b* is guided along the tapering surface of the arm part 76*a*, and is gradually pushed towards the container guide member 60. Therefore, the user can push in the container holder 75 without feeling a strong resistance. As the end 64*b* of the torsion spring 64 is gradually pushed, the torsion spring 64 rotates. With this rotation, the other end 64*a* of the torsion spring 64 inserted in the oblong hole 65*b* gradually generates a force to push the contact member 65 towards the toner container 50. At this point, the bag part 51 is filled up with toner and inflated, so the contact member 65 cannot push further into the bag part 51. Therefore, the pressure applied to the contact member 65 is absorbed by the torsion spring 64. As a result, the contact member 65 strongly pushes against the fold line f.

As the torsion spring 64 is separable from the contact member 65 and the arm part 76*a*, the level of pressure can be easily adjusted, simply by exchanging the torsion spring 64. This increases the freedom in designing the container holder.

Figure 18:
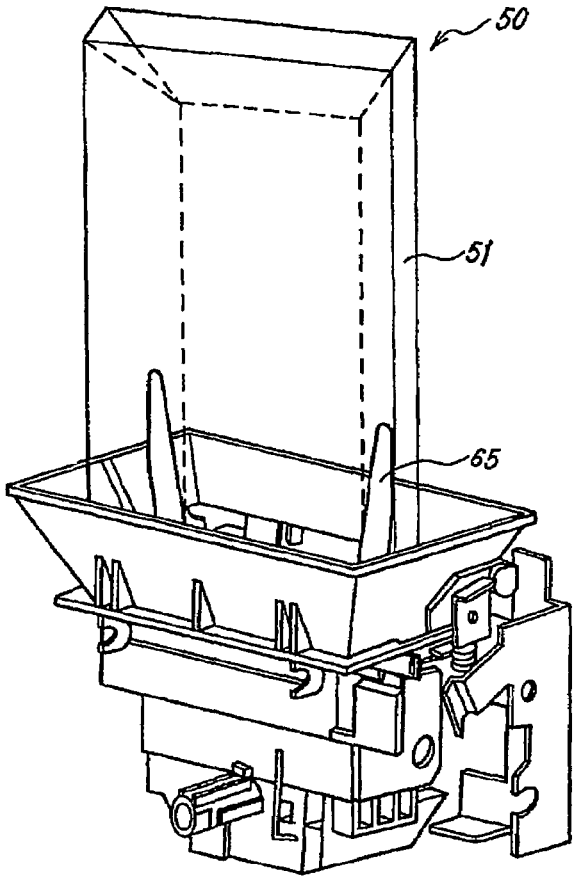
FIG. 18 is a perspective view of the external pressurizing unit when a toner container is set.

As the toner is consumed and the bag part 51 shrinks due to suction, the contact members 65 gradually move toward the toner container 50, as shown in FIG. 18. Thus, the bag part 51 neatly folds along the fold lines f without forming any creases. Because the toner does not get caught in any creases, even toner of low fluidity can be stably discharged, and the toner can be completely consumed. The bag part 51 is in a taper form, decreasing in diameter towards the mouth part 52, so that the toner smoothly moves downwards to the mouth part 52. Hence, the amount of the bag part 51 to be folded inside increases towards the direction opposite to the mouth part 52. For this reason, the contact members 65 are rotatably fixed to the bottom of the container guide member 60, where the mouth part 52 is inserted. As a result, the contact members 65 move to a greater extent towards the direction opposite to the mouth part 52, so that the bag part 51 is thoroughly folded.

The contact members 65 do not have to contact the fold lines f entirely. If the contact members 65 contact the fold lines f at least where the upper half and the bottom half of the bag part 51 meet, the bag part 51 can fold smoothly.

Figure 19:
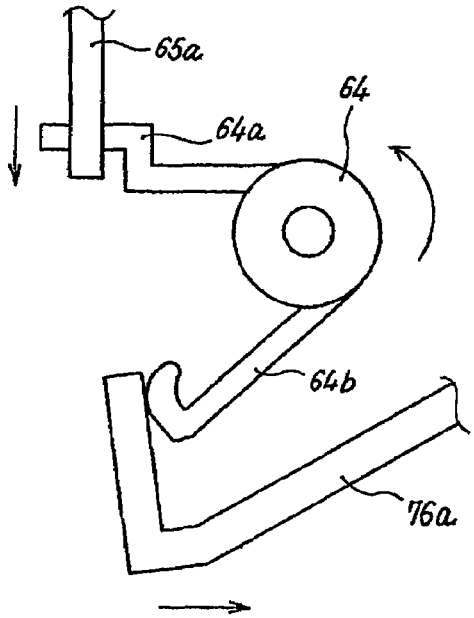
FIG. 19 is a side view of relevant parts of another example of the external pressurizing unit when the container holder is open.

In the present embodiment, the contact members 65 are configured to lean to the withdrawn positions by their own weight, but another mechanism can be employed. FIG. 19 illustrates an example in which the edge of the arm part 76*a* bends inward toward the container guide member 60, so that the end 64*b* of the torsion spring 64 is pushed toward the fixing member 76, when the container holder 75 is opened. The torsion spring 64 rotates in an anti-clockwise direction, moving down the other end 64*a* of the torsion spring 64 that is inserted through the oblong hole 65*b*. As a result, the contact member 65 moves to the withdrawn position. When the container holder 75 is closed, the above mechanism is performed in reverse, moving the contact member 65 to the holding position. This mechanism ensures that the contact members 65 move out of the way when the toner container 50 is being attached or detached.

Figure 20:
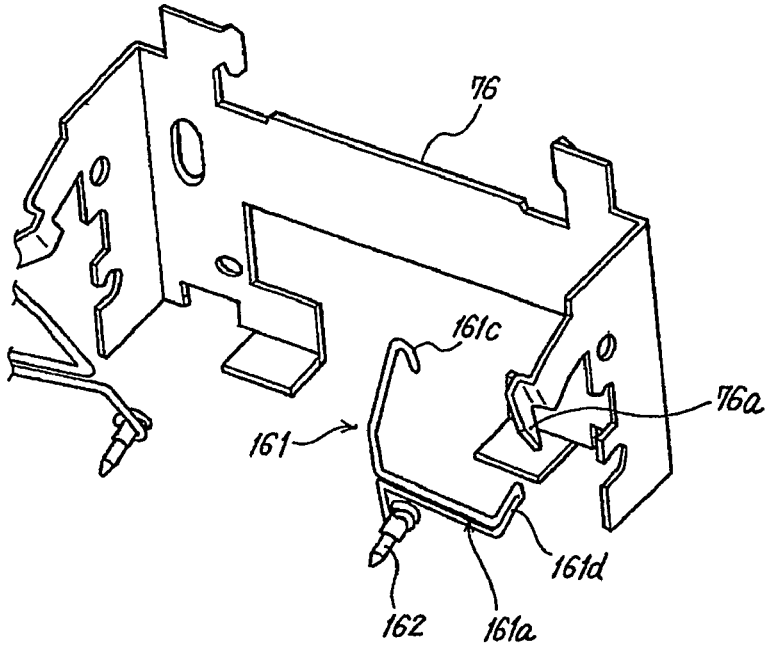
FIG. 20 describes another example of the external pressurizing unit when the container holder is open.
Figure 21:
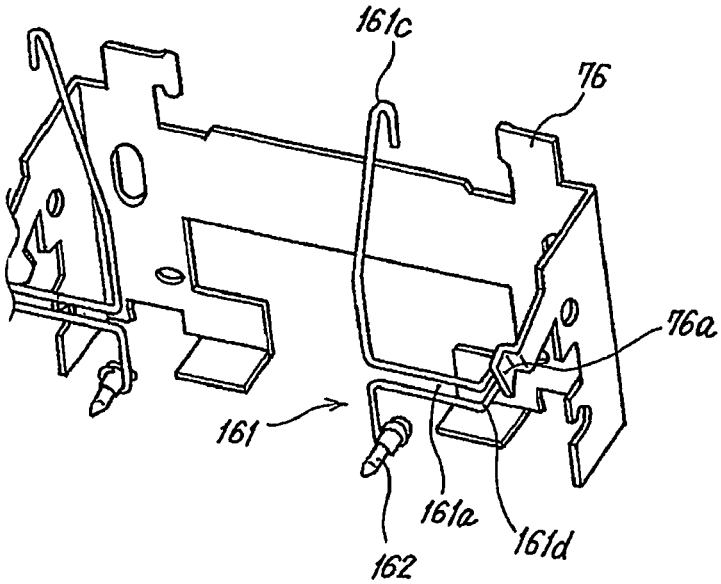
FIG. 21 describes the external pressurizing unit shown in FIG. 20 when the container holder is closed.

FIGS. 20 and 21 are perspective views of relevant parts of another example of the external pressurizing unit, when the container holder 75 is open and closed, respectively. The external pressurizing unit includes an external pressurizing member 161 made by bending a rigid material, and the arm part 76*a* that presses the external pressurizing member 161 toward the toner container 50. The external pressurizing member 161 includes a bag contact part 161*c* that contacts the fold line f of the bag part 51, a pressing part 161*a* that presses the bag contact part 161*c* against the bag part 51, and an arm contact part 161*d* that contacts the arm part 76*a* of the fixing member 76. The bottom part of the external pressurizing member 161 is rotatably attached to the inner-front part of the container guide member 60 (not shown) by a turn down screw 162. The external pressurizing member 161 is bent outwards at the middle, forming the pressing part 161*a*. The outer edge of the pressing part 161*a* bends towards the fixing member 76, forming the arm contact part 161*d*. The bag contact part 161*c* is located at the upper part of the external pressurizing member 161.

Figure 22:
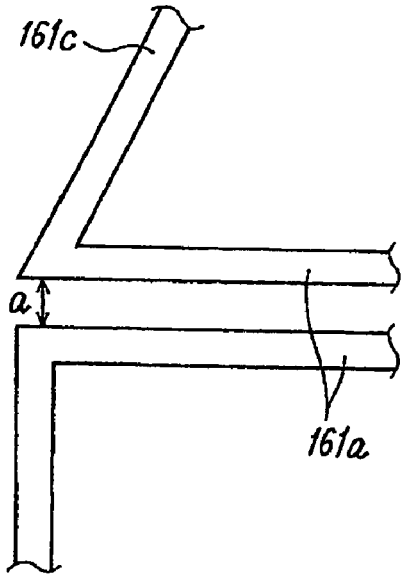
FIG. 22 is an enlarged view of the middle part of the external pressurizing unit shown in FIG. 20.
Figure 23:
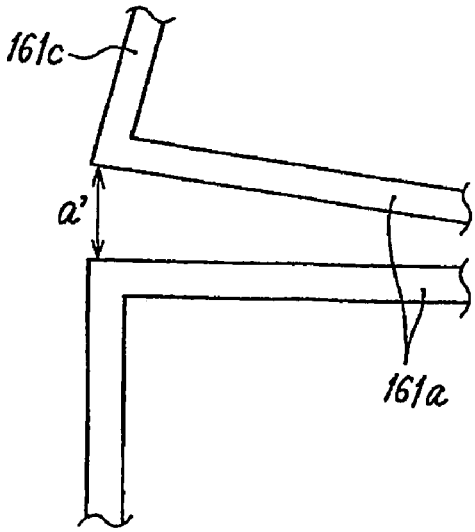
FIG. 23 is an enlarged view of the middle part of the external pressurizing unit shown in FIG. 21.

When the container holder 75 is open, the arm contact part 161*d* is detached from the arm part 76*a*, so that the external pressurizing member 161 is not supported by the arm part 76*a*. As a result, the bag contact part 161*c* leans towards the side of the container guide member 60 to a withdrawn position, by the weight of the pressing part 161*a* and the arm contact part 161*d*. Therefore, a used toner container 50 can be smoothly replaced with a new one without being obstructed by the bag contact part 161*c*. When the new toner container 50 is fixed, and the user closes the container holder 75, the arm contact part 161*d* comes in contact with the arm part 76*a*. As the arm part 76*a* is a tapering surface, the arm contact part 161*d* is gradually pushed towards the container guide member 60, as the user pushes the container holder 75. Then, the bag contact part 161*c* gradually pushes against the fold line f of the bag part 51. At this point, the bag part 51 is filled up with toner and inflated, so the bag contact part 161*c* cannot push further into the bag part 51. Therefore, the pressure applied to the bag contact part 161*c* is absorbed by the pressing part 161*a*. As a result, a gap a in the pressing part 161*a* opens wider to the gap a', as illustrated in FIGS. 22 and 23.

When the container holder 75 is closed, the contact the bag contact parts 161*c* push against the fold lines f, so that the bag part 51 folds along the fold lines f. As the toner is consumed and the bag part 51 shrinks, the bag contact parts 161*c* cause the bag part 51 to neatly fold along the fold lines f without forming any creases. The bag contact parts 161*c* are rotatably fixed to the bottom of the container guide member 60. Hence, the bag contact parts 161*c* move to a greater extent towards the direction opposite to the mouth part 52, in proportion to the amount of the bag part 51 to be folded inside, so that the bag part 51 is thoroughly folded.

The conveying device in the present embodiment conveys toner, however, the same effects can be achieved with any other powder, liquid, or gas.

According to the present invention, the external pressurizing unit 61 applies a lower pressure to both sides of the bag part 51 when the container guide member 60 is at the open position (a first position) than when the container guide member 60 is at the closed position (a second position). Thus, the user can attach the toner container 50 into the container guide member 60 without strongly pushing the toner container 50, so that the toner container 50 is not crushed.

Moreover, as the pressure is automatically released from the bag part 51 as the user opens the container holder 75, an additional operation to release the pressure is not required. Because the pressure is released, the toner container 50 is not obstructed or torn when being replaced. Therefore, the bag part 51 can be made of a soft material that gets neatly folded without forming creases. This allows the toner, or any other content, to be stably discharged and conveyed to another device, without getting caught in creases.

Furthermore, the toner container 50 shrinks into a small, fixed shape along the fold lines f, reducing transportation costs when the used toner containers 50 are returned to the manufacturer for recycling purposes.

The contact members 65 that apply the pressure are configured to move aside to the withdrawn positions by their own weight. Therefore, the external pressurizing unit 61 has a simple structure without requiring additional pressurizing or driving devices, which reduces production costs and the incidence of failure.

INDUSTRIAL APPLICABILITY

The container holding device, the conveying device, the image forming apparatus, and the method of fixing the container according to the present invention provide a useful technology when replacing a used container with a new container. One example of the container is a toner container of the image forming apparatus.

The invention claimed is:

1. A container holding device, comprising:

a container holding member for holding a container that is configured to be detachably attached to the container holding member, wherein the container includes a soft, bag-shaped member that stores contents, and shrinks as external pressure is applied or internal pressure is reduced, the container holding member configured to move between a first position that is a position at which the container is attached to or detached from the container holding member and a second position that is a position at which the contents of the container is configured to be discharged;

a moving unit that moves the container holding member between the first position and the second position; and an external pressurizing unit that applies external pressure to the bag-shaped member at least while the container holding member is at the first position and the second position so that the bag-shaped member shrinks when the contents are being discharged, wherein the external pressurizing unit applies a lower pressure to the bag-shaped member when the container holding member is at the first position than when the container holding member is at the second position.

2. The container holding device according to claim 1, wherein the external pressurizing unit includes an arrangement that changes the pressure applied to the bag-shaped member in conjunction with the movement of the container holding member between the first position and the second position.

3. The container holding device according to claim 1, wherein the external pressurizing unit includes an arrangement that moves the external pressurizing unit, when the container holding member is at the first position, to a withdrawn position, that is a position at which the external pressurizing unit does not cause obstruction while the container is being attached or detached.

4. The container holding device according to claim 1, wherein the external pressurizing unit includes an arrangement that moves the external pressurizing unit between a withdrawn position, which is a position at which the external pressurizing unit does not obstruct the bag-shaped member, and a pressurizing position at which the external pressurizing unit applies pressure to the bag-shaped member, in conjunction with the movement of the container holding member between the first position and the second position.

5. The container holding device according to claim 4, further comprising:

a supporting mechanism that supports the external pressurizing unit at the pressurizing position, and releases the external pressurizing unit when the container holding member is at the first position, so that the external pressurizing unit moves to the withdrawn position by its own weight.

6. The container holding device according to claim 3, wherein the container holding member is a box that holds the container, and the external pressurizing unit includes a part that protrudes outside the container holding member when the external pressurizing unit is at the withdrawn position.

7. The container holding device according to claim 1, wherein the external pressurizing unit includes an arrangement that applies pressure to two opposing sides of the bag-shaped member.

8. The container holding device according to claim 1, wherein the bag-shaped member includes a tapering part that gradually decreases in cross-sectional area towards an outlet of the container from where the contents are discharged, and the external pressurizing unit applies pressure at least to a part where the tapering part starts to taper.

9. The container holding device according to claim 1, wherein the bag-shaped member is provided with fold lines, and the external pressurizing unit applies pressure to the fold lines.

10. The container holding device according to claim 1, wherein the external pressurizing unit comprises:

a contact member having two ends, wherein one end of the contact member is rotatably attached to the container holding member and the other end contacts the bag-shaped member;

a pressing member that presses the contact member against the container; and a pressurizing mechanism that applies pressure to the contact member in a direction towards the container, but does not apply pressure to the contact member when the container holding member is at the first position.

11. The container holding device according to claim 10, wherein the one end of the contact member is attached to the container holding member at a part near an outlet of the container from where the contents are discharged.

12. The container holding device according to claim 10, wherein the pressing member is separable from the pressurizing mechanism and the contact member.

13. The container holding device according to claim 1, wherein the contents is toner that is used in an image forming apparatus.

14. A conveying device, comprising:

a container holding part that includes a container holding member for holding a container that is configured to be detachably attached to the container holding member, wherein the container includes a soft, bag-shaped member that stores contents, and shrinks as external pressure is applied or internal pressure is reduced, the container holding member configured to move between a first position that is a position at which the container is attached to or detached from the container holding member and a second position that is a position at which the contents of the container is configured to be discharged;

a moving unit that moves the container holding member between the first position and the second position; and an external pressurizing unit that applies external pressure to the bag-shaped member at least while the container holding member is at the first position and the second position so that the bag-shaped member shrinks when the contents are being discharged, wherein the external pressurizing unit applies a lower pressure to the bag-shaped member when the container holding member is at the first position than when the container holding member is at the second position;

a discharging unit that causes the contents to be discharged from an outlet of the container by causing the bag-shaped member to shrink by applying the external pressure to the bag-shaped member or reducing the internal pressure in the bag-shaped member; and a conveying member that conveys the contents discharged from the outlet to another device.

15. An image forming apparatus that includes a developing device in which toner adheres to a latent image formed on a latent image carrier so that the latent image is developed into a toner image, and that transfers the toner image to a recording material so as to form a visual image, the image forming apparatus comprising:

a container holding part that includes a container holding member for holding a container that is configured to be detachably attached to the container holding member, wherein the container includes a soft, bag-shaped member, and shrinks as external pressure is applied or internal pressure is reduced, the container holding member configured to move between a first position that is a position at which the container is attached to or detached from the container holding member and a second position that is a position at which the contents of the container is configured to be discharged;

a moving unit that moves the container holding member between the first position and the second position; and an external pressurizing unit that applies external pressure to the bag-shaped member at least while the container holding member is at the first position and the second position so that the bag-shaped member shrinks when the contents are being discharged, wherein the external pressurizing unit applies a lower pressure to the bag-shaped member when the container holding member is at the first position than when the container holding member is at the second position;

a discharging unit that causes the contents to be discharged from an outlet of the container by causing the bag-shaped member to shrink by applying the external pressure to the bag-shaped member or reducing the internal pressure in the bag-shaped member; and a conveying member that conveys the contents discharged from the outlet to another device.

16. A method of fixing a container to a container holding device that includes a container holding member, the container including a soft, bag-shaped member that stores contents, shrinks as external pressure is applied or internal pressure is reduced, and is configured to be detachably attached to the container holding member, the method comprising:

moving the container holding member to a first position that is a position at which the container is attached to or detached from the container holding member, from a second position that is a position at which the contents of the container can be discharged;

placing the container in the container holding member at the first position;

allowing the container to drop by its own weight until an outlet of the container is set where the contents are discharged;

moving the container holding member from the first position to the second position; and increasing a pressure that is applied to the bag-shaped member as the container holding member moves from the first position to the second position.

* * * * *

UNITED STATES PATENT AND TRADEMARK OFFICE

CERTIFICATE OF CORRECTION

PATENT NO. : 7,457,564 B2
APPLICATION NO. : 10/560778
DATED : November 25, 2008
INVENTOR(S) : Takami It is certified that error appears in the above-identified patent and that said Letters Patent is hereby corrected as shown below:

On the title page, Item (30), the Foreign Application Priority Data is missing. Item (30) should read:

-- (30) Foreign Application Priority Data

Mar. 19, 2004 (JP) . . . . . 2004-081611
Sept. 27, 2004 (JP) . . . . . 2004-279113 --

Signed and Sealed this

Twentieth Day of January, 2009

JON W. DUDAS
*Director of the United States Patent and Trademark Office*